United States Patent [19]

Matsui et al.

[11] Patent Number: 5,052,172

[45] Date of Patent: Oct. 1, 1991

[54] METHOD OF UNTWISTING SIZED YARN IN A YARN SPLICING DEVICE

[75] Inventors: Isamu Matsui, Kyoto; Hiroshige Maruki, Kusatsu, both of Japan

[73] Assignee: Murata Kikai Kabushiki Kaisha, Kyoto, Japan

[21] Appl. No.: 540,316

[22] Filed: Jun. 20, 1990

Related U.S. Application Data

[63] Continuation of Ser. No. 314,444, Feb. 23, 1989, abandoned.

[30] Foreign Application Priority Data

Feb. 24, 1988 [JP] Japan ..... 63-39641

[51] Int. Cl.[5] ..... D01H 15/00

[52] U.S. Cl. ..... 57/22; 57/1 UN

[58] Field of Search ..... 57/1 UN, 22, 261, 263

[56] References Cited

U.S. PATENT DOCUMENTS

| | | | |
|---|---|---|---|
| 4,263,775 | 4/1981 | Mima | 57/22 |
| 4,428,992 | 1/1984 | Street | 57/22 X |
| 4,499,715 | 2/1985 | Chardon et al. | 57/22 |
| 4,506,497 | 3/1985 | Feuerlohn | 57/22 |
| 4,608,816 | 9/1986 | Bertrams et al. | 57/22 |
| 4,653,258 | 3/1987 | Rohner | 57/22 |
| 4,765,128 | 8/1988 | Rosen | 57/22 |

FOREIGN PATENT DOCUMENTS

| | | |
|---|---|---|
| 47108 | 11/1981 | Japan . |
| 3742 | 1/1987 | Japan . |

*Primary Examiner*—Joseph J. Hail, III

*Attorney, Agent, or Firm*—Spensley Horn Jubas & Lubitz

[57] ABSTRACT

A method of untwisting sized yarn in a yarn splicing device, which comprises applying a solution to the ends of sized yarn to dissolve a size to thereby untwist the yarn at the ends thereof when they are joined together by a whirling stream of air.

5 Claims, 1 Drawing Sheet

METHOD OF UNTWISTING SIZED YARN IN A YARN SPLICING DEVICE

This is a continuation of application Ser. No. 314,444, filed on 2/23/89, now abandoned.

FIELD OF THE INVENTION

This invention relates to a method of untwisting sized yarn in a yarn splicing device More particularly, it is a method which facilitates the untwisting of sized yarn.

The warp in a loom is usually sized, so that its strength may be increased. When the warp is broken, it has been usual to join the broken ends thereof to each other manually.

A splicing device is disclosed in, for example, Japanese Patent Publication No. 47108/1981 or 3742/1987. It is convenient, as it can join the broken yarn quickly without forming any knot.

The known splicing device is designed for untwisting yarn at the broken ends thereof and applying a whirling stream of air to the untwisted ends to rotate them to thereby join them together. This device, however, cannot untwist the broken ends of any warp, since the warp is sized as hereinabove stated. Therefore, it cannot be used for splicing the warp.

OBJECT AND SUMMARY OF THE INVENTION

It is an object of this invention to overcome the drawback of the prior art as hereinabove pointed out and provide a method which facilitates the untwisting of sized yarn and can, therefore, be employed for joining sized yarn in a yarn splicing device.

This object is attained by a method which comprises applying a solution to the ends of sized yarn to dissolve a size to thereby untwist the yarn at the ends thereof when they are joined together by a whirling stream of air in a yarn splicing device.

The broken ends of sized yarn are untwisted after the solution has been applied thereto to dissolve the size. This method facilitates the untwisting of yarn at their broken ends and, therefore, enables the joining of any broken sized yarn in a yarn splicing device.

DETAILED DESCRIPTION OF PREFERRED EMBODIMENTS

The invention will now be described by way of example with reference to the accompanying drawing.

Figure 1:
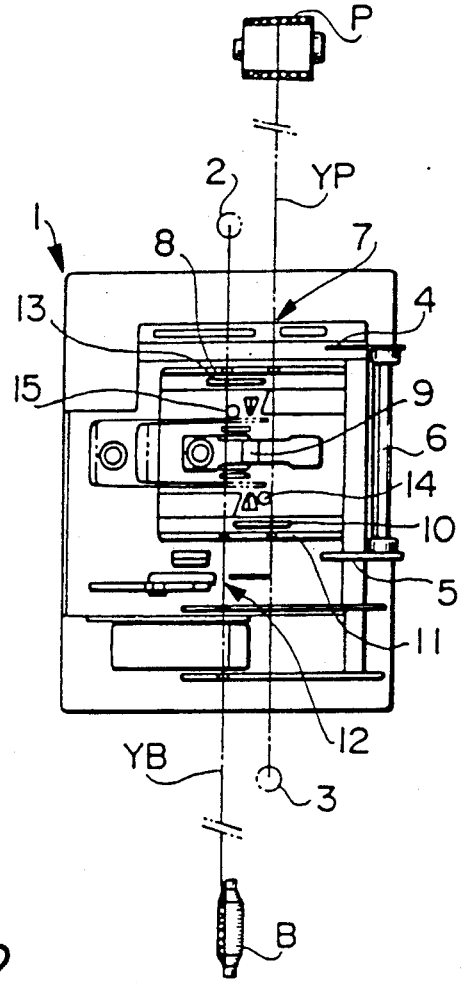
FIG. 1 is a front elevational view of a splicing device which can be employed for carrying out this invention.
Figure 2:
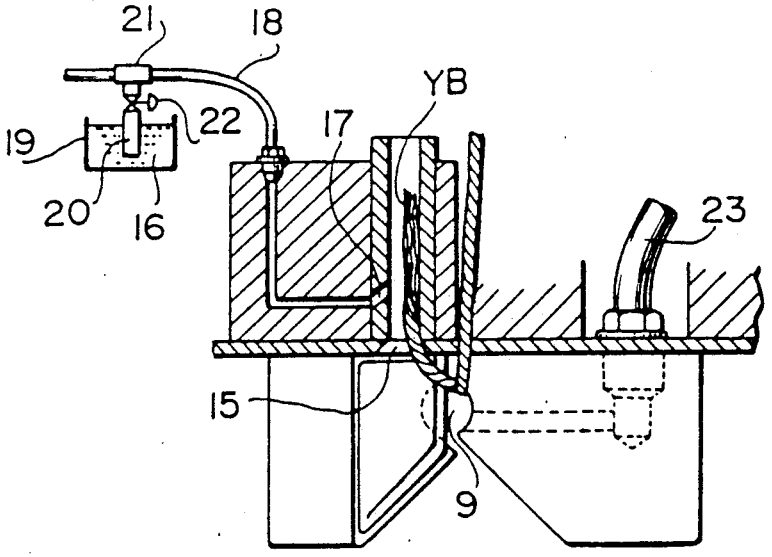
FIG. 2 is a cross sectional view showing the construction of the device in the vicinity of a nozzle.

FIG. 1 shows a splicing device 1 provided in an automatic winder. If yarn (sized yarn) extending from a bobbin B to a package P is broken, suction arms 2 and 3 hold under suction the yarn portion YB extending from the bobbin and the yarn portion YP extending to the package, respectively, and guide them to the front side of the splicing device 1 by means of mechanisms not shown. Yarn handling levers 4 and 5 are rotatably supported on a shaft 6 at one side of the splicing device 1 for catching the yarn portions YB and YP which have been guided to the front side of the splicing device 1 by the suction arms 2 and 3, and for guiding them to the inside of the device. The yarn portion YP is, thus, caused to extend to the suction pipe 3 through a clamp 7, the right slot of a fork guide 8, a splicing hole 9, a yarn cutter 10 and the right slot of a fork guide 11. On the other hand, the yarn portion YB extends to the suction pipe 2 through a clamp 12, the left slot of the fork guide 11, the splicing hole 9, a yarn cutter 13 and the left slot of the fork guide 8. The clamps 7 and 12 clamp the yarn portions YP and YB, respectively, and the yarn cutters 10 and 13 cut the clamped yarn portions YP and YB, respectively. The cut yarn ends YP and YB are drawn into nozzles 14 and 15, respectively, which are located close to each other, and a solution 16 for dissolving the size is sprayed onto the yarn ends, whereby they are each untwisted.

The nozzles 14 and 15 are each provided with a port 17 through which a whirling stream of air is jetted against the yarn end YP or YB to untwist it. The port 17 is connected to a source of compressed air supply through a pipe 18. The pipe 18 is provided with an injector 21 into which the solution 16 is drawn from a solution tank 19 through a suction tube 20. The suction tube 20 is provided with a valve 22. The solution may be either cold or hot water, or a solvent which can dissolve the size (for example, a mixture of caustic soda and lactogen). The pipe 18 is adapted to start supplying compressed air when the yarn cutters 10 and 13 are placed in operation, and continue supplying it until splicing is started. The valve 22 is controlled for opening as soon as the supply of compressed air is started, and for closing before the supply of compressed air is discontinued. The supply of compressed air is continued for a certain length of time even after the closing of the valve 22 to dry the yarn ends YP and YB to facilitate their untwisting.

After the yarn ends YP and YB have been untwisted, the yarn collecting levers 4 and 5 are further rotated to bring the yarn ends YP and YB together in the splicing hole 9. The splicing hole 9 is connected to a source of compressed air supply through a pipe 23, so that a whirling stream of air may be supplied to the yarn ends YP and YB brought together in the splicing hole 9 to join them to each other.

As the solution 16 forms a mist with compressed air when it is sprayed onto the yarn ends YP and YB in the nozzles 14 and 15, it can effectively dissolve the size away from the yarn ends YP and YB and thereby untwist them. As the valve 22 is so controlled that the supply of compressed air into the nozzles 14 and 15 is continued for some time even after the spraying of the solution 16 has been discontinued, the yarn ends YP and YB are dried and untwisted still more satisfactorily. The untwisted yarn ends YP and YB are brought together in the splicing hole 9 and joined to each other under the action of a whirling stream of air.

As the yarn ends are untwisted after the solution has been sprayed onto them to dissolve or decompose the size, it is possible to untwist even sized yarn easily and it is, therefore, possible to join sized yarn in a splicing device. As it is possible to join sized yarn in a splicing device, it is possible to provide a loom with a splicing device for joining any broken portions of the warp. As the solution is sprayed in the nozzles 14 and 15, there is no possibility of the solution scattering and contaminating the environment.

The yarn which had been joined as hereinabove described was examined for strength at its joint. It was found to have a high degree of strength. If the size is so removed that a small amount of the size may remain at the ends of yarn to be joined, it is possible to achieve a still higher degree of yarn strength, as the remaining size solidifies after they are joined together.

Although the solution has been described as being sprayed in the nozzles 14 and 15, it is also possible to spray it when the yarn is cut by the cutters 10 and 13, insofar as it is effective to apply the solution to the yarn before it is untwisted.

Although the solution has been described as being sprayed onto the yarn ends YP and YB, it is alternatively possible to dip the yarn ends YP and YB in the solution. It is also effective to blow hot air against the yarn ends YP and YB to dry them, though no such drying is essential.

Some experimental results which are obtained in case that the ends of sized yarn are dipped in water before splicing are shown in Table 1. In Table 1, the minimum strength shows the three small values from minimum value of strength in 30 examples.

TABLE 1

| | Mean strength (g) | Minimum strength (g) | Mean extension (mm) | Retaining ratio (%) (Strength) |
|---|---|---|---|---|
| Parent yarn | 353 | 245<br>278<br>280 | 9 | |
| Spliced yarn A | 320 | 153<br>252<br>266 | 11 | 90.8 |
| Spliced yarn B | 316 | 236<br>244<br>254 | 10 | 89.5 |

Yarn kind: Cotton
Yarn number: Ne 30
Length of sample yarn: 300 mm
Number of examined sample: 30
Spliced yarn A: just after splicing (wet)
Spliced yarn B: 24 hrs. after splicing (dry)

This invention ensures and facilitates the untwisting of sized yarn at the broken ends thereof and thereby makes it possible to join any broken sized yarn in a splicing device, as the ends of the yarn are untwisted after the size has been dissolved away from them by the solution.

What is claimed is:

1. A method of splicing the ends of spun yarn treated by a sizing agent in a yarn splicing device, the method comprising:

facilitating untwisting of the ends of the spun yarn by dissolving at least a portion of the sizing agent from the ends of the spun yarn by applying a solution of the ends of the spun yarn, untwisting the ends of the spun yarn such that the yarn ends are dried, and joining the dry untwisted ends of the spun yarn by a whirling stream of air.

2. The method as claimed in claim 1, wherein the step of dissolving at least a portion of the sizing agent by applying a solution to the ends of the spun yarn comprises the step of spraying to the ends of the spun yarn comprises the step of spraying a solution onto the ends of the spun yarn.

3. A device for splicing the ends of spun yarn treated by a sizing agent, comprising:

cutting means for cutting the ends of the spun yarn, facilitating means for facilitating untwisting of the ends of the spun yarn, the facilitating means including sizing agent dissolving means for dissolving at least a portion of the sizing agent from the ends of the spun yarn, the sizing agent dissolving means comprising solution applying means for applying solution to the ends of the spun yarn to thereby dissolve at least a portion of the sizing agent from the ends of the spun yarn, untwisting means for untwisting the ends of the spun yarn such that the yarn ends are dried, and pneumatic splicing means for pneumatically splicing the dry untwisted ends of the spun yarn.

4. The yarn splicing device as claimed in claim 3, wherein the solution applying means comprises:

a source of compressed air, a port provided in the untwisting means for supplying jetting air streams to the yarn end to thereby untwist the ends of the spun yarn, a pipe through which the compressed air is supplied to the port, a suction device provided on the pipe, and a solution tank.

5. The yarn splicing device as claimed in claim 4, wherein the suction device comprises:

a valve, means for opening the valve when the compressed air is supplied to the port, and means for closing the valve before the supply of compressed air to the port is discontinued.

* * * * *